US008842434B2

(12) United States Patent
Chen et al.

(10) Patent No.: US 8,842,434 B2
(45) Date of Patent: Sep. 23, 2014

(54) HEAT DISSIPATION SYSTEM

(75) Inventors: Chien-An Chen, Taipei (TW); Kai-Yang Tung, Taipei (TW)

(73) Assignee: Inventec Corporation, Taipei (TW)

( * ) Notice: Subject to any disclaimer, the term of this patent is extended or adjusted under 35 U.S.C. 154(b) by 261 days.

(21) Appl. No.: 13/409,965

(22) Filed: Mar. 1, 2012

(65) Prior Publication Data

US 2013/0118710 A1 May 16, 2013

(30) Foreign Application Priority Data

Nov. 11, 2011 (TW) ..... 100141272 A

(51) Int. Cl.

| | |
|---|---|
| ***H05K 7/20*** | (2006.01) |
| ***F28D 15/00*** | (2006.01) |
| ***F25D 31/00*** | (2006.01) |
| *F28D 21/00* | (2006.01) |
| *F28D 15/06* | (2006.01) |

(52) U.S. Cl.

CPC ..... *F25D 31/00* (2013.01); *F28D 15/00* (2013.01); *F28D 2021/0028* (2013.01); *F28D 15/06* (2013.01)

USPC ..... 361/698; 361/689; 361/699; 361/701; 361/679.46; 361/679.53; 165/80.4

(58) Field of Classification Search

None

See application file for complete search history.

(56) References Cited

U.S. PATENT DOCUMENTS

| | | | | |
|---|---|---|---|---|
| 6,714,412 | B1 * | 3/2004 | Chu et al. | 361/699 |
| 7,050,299 | B2 * | 5/2006 | Kondo et al. | 361/689 |
| 7,408,775 | B2 * | 8/2008 | Walz et al. | 361/699 |
| 7,522,418 | B2 * | 4/2009 | Ishimine | 361/699 |
| 7,551,440 | B2 * | 6/2009 | Belady et al. | 361/699 |
| 7,641,101 | B2 * | 1/2010 | Campbell et al. | 228/183 |
| 7,944,694 | B2 * | 5/2011 | Campbell et al. | 361/699 |
| 8,199,504 | B2 * | 6/2012 | Kashirajima et al. | 361/700 |
| 8,441,789 | B2 * | 5/2013 | Wu et al. | 361/679.49 |
| 8,542,489 | B2 * | 9/2013 | Arney et al. | 361/701 |
| 2009/0009958 | A1 * | 1/2009 | Pflueger | 361/687 |

FOREIGN PATENT DOCUMENTS

| | | |
|---|---|---|
| TW | I237174 | 8/2005 |

* cited by examiner

*Primary Examiner* — Boris Chervinsky

(74) *Attorney, Agent, or Firm* — Huffman Law Group, PC

(57) ABSTRACT

A server rack heat dissipation system for a server including an electronic component comprises a first and a second heat dissipation assembly. The first heat dissipation assembly includes a first heat exchanger and a first pipeline. The first heat exchanger is inside the server rack and in thermal contact with the electronic component. The first pipeline is in thermal contact with the first heat exchanger and has a first coolant. The second heat dissipation assembly includes a second heat exchanger. The second heat exchanger is inside the server rack and in thermal contact with the first pipeline. The second heat exchanger can remove the heat of the electronic component in the first coolant in advance. Accordingly, the time of the first coolant being maintained in a vapor phase can be shortened, so that a power the fluid driving device used for driving the first coolant is reduced.

18 Claims, 8 Drawing Sheets

HEAT DISSIPATION SYSTEM

CROSS-REFERENCE TO RELATED APPLICATIONS

This non-provisional application claims priority under 35 U.S.C. §119(a) on Patent Application No(s). 100141272 filed in Taiwan, R.O.C. on Nov. 11, 2011, the entire contents of which are hereby incorporated by reference.

BACKGROUND

1. Technical Field

The present disclosure relates to a heat dissipation system and more particularly to a heat dissipation system which is energy-efficient.

2. Related Art

Generally, electronic devices include desktop computer, laptop, tablet computer, personal digital assistant (PDA) and server, there are various types of electronic components inside an electronic device, and each electronic component has a temperature range within which it can operate normally. If the temperature of the electronic component exceeds the operating temperature range, it may operate abnormally, for examples the electronic device may be down or may be damaged due to the electronic component overheated. Fire may even breakout because of the overly high temperature. Therefore, most of the electronic devices employ heat dissipation modules, such as liquid cooling devices, in order to reduce the temperature of the electronic component. Thereby, the electronic component can be operated within the normal operating temperature range, so as to prevent the electronic component from operating abnormally.

The liquid cooling device has a pipeline, a radiator and a pump. The pipeline has a heat absorbing section and a heat dissipation section. The heat absorbing section is in thermal contact with an electronic component of the electronic device, and the heat dissipation section is in thermal contact with the radiator. Furthermore, there is a coolant inside the pipeline. When the pump drives the coolant to flow to the heat absorbing section, because the temperatures of the electronic components are higher than that of the heat absorbing section of the pipeline, the quantity of heat released by the electronic components will be conducted to the heat absorbing section of the pipeline. At this point, because the temperature of the coolant is lower than that of the pipeline, heat will be conducted from the pipeline to the coolant. Then, the temperature of the coolant increases because of the heat absorbed. Next, the coolant with a high temperature is sent to the heat dissipation section by the pump. Because the temperature of the coolant is higher than that of the radiator, the heat is released and conducted to the radiator through the pipeline so that the temperature of the coolant is lowered. Then the coolant with a reduced temperature will be sent back to the pump to complete a cooling cycle.

The abovementioned coolant can be maintained in single-phase without changes during the cooling cycle, and only the sensible heat of the coolant contributes to the cooling of the electronic component. Or, the abovementioned coolant can transform between liquid-phase and vapor-phase. In this case, the latent heat of the coolant absorbed during phase transition (i.e. changed from liquid phase to vapor phase) is involved to cool down the electronic component. The difference between the two lies in that the latent heat is a lot higher than the sensible heat.

However, even though the coolant is able to absorb a large quantity of heat released by the electronic components through phase transition, the flow resistance between the gaseous coolant and the pipeline is a lot higher than that between the liquid coolant and the pipeline. Therefore, after the coolant is vaporized, larger power is consumed by the pump in order to drive the coolant to cycle inside the pipeline. Also, when there is too much gaseous coolant inside the pipeline causing excessive flow resistance between the coolant and the pipeline, a compressor of higher power consumption is required to drive the coolant to cycle inside the pipeline. Therefore, achieving balance between an efficiency of temperature reduction and power consumption of the heat dissipation system is a problem.

SUMMARY

In one aspect, a server rack heat dissipation system for a server rack that includes an electronic component comprises first and second heat dissipation assemblies. The first heat dissipation assembly includes a first heat exchanger and a first pipeline. The first heat exchanger is disposed inside the server rack and is in thermal contact with the electronic component. The first pipeline is in thermal contact with the first heat exchanger and has a first coolant. The second heat dissipation assembly includes a second heat exchanger also disposed inside the server rack and also in thermal contact with the first pipeline. When the heat dissipation system is in operation, the first coolant inside the first pipeline exchanges heat with the first heat exchanger, and then the first coolant inside the first pipeline exchanges heat with the second heat exchanger.

In another aspect, a data center heat dissipation system comprises first and second rack heat dissipation circuits and a first fluid driving device. The first rack heat dissipation circuit comprises a first pipeline carrying a first coolant and a first heat exchanger, in thermal contact with the first pipeline and an electronic component, that transfers heat from the electronic component to the first pipeline. A second heat exchanger is relatively proximate to the first heat exchanger and is also in thermal contact with the first pipeline. The second heat exchanger removes heat from the first pipeline. The first fluid driving device, relatively distal to the first and second heat exchangers, circulates the first coolant through the first pipeline. The second rack heat dissipation circuit comprises a second pipeline and a second fluid driving device circulating a second coolant that is isolated from the first coolant, wherein the first and second coolants do not mix. The second pipeline is also in thermal contact with the second heat exchanger for removing heat from the second heat exchanger. A third heat exchanger in thermal contact with the second pipeline is provided to remove and dissipate heat from the second pipeline. When the heat dissipation system is in operation, the first coolant circulates through the first pipeline to remove heat from the electronic component and transfer it to the second heat exchanger, and the second coolant circulates through the second circuit to remove heat from the second heat exchanger and transfer it to the third heat exchanger.

In yet another aspect, a method is provided of removing waste heat from electronic components in a server. The method comprises circulating first and second cooling fluids, respectively, through first and second heat dissipation pipeline circuits. The first heat dissipation pipeline circuit is in thermal contact with a pair of relatively proximately located first and second heat exchangers. The first heat exchanger is in thermal contact with an electronic component. The first rack heat dissipation circuit also includes a first fluid driving device located relatively distal of the pair of first and second heat exchangers. The second heat dissipation pipeline circuit is also in thermal contact with the second heat exchanger, so that the second cooling fluid removes heat from the second heat exchanger.

BRIEF DESCRIPTION OF THE DRAWINGS

The present disclosure will become more fully understood from the detailed description given herein below for illustration only, and thus are not limitative of the present disclosure, and wherein.

DETAILED DESCRIPTION

Figure 1:
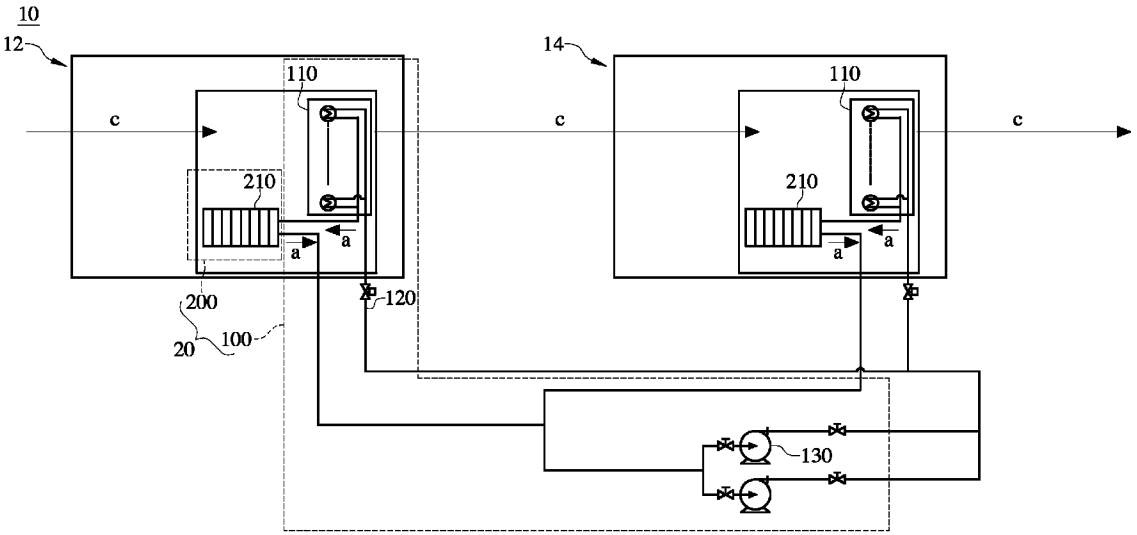
FIG. 1 is a flat illustration of a data center of a first embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In view of the abovementioned problem, some embodiments of the disclosure relate to a heat dissipation system to solve the problem that a high efficiency of temperature reduction is hard to be achieved while a low power consumption is pursued.

Figure 2:
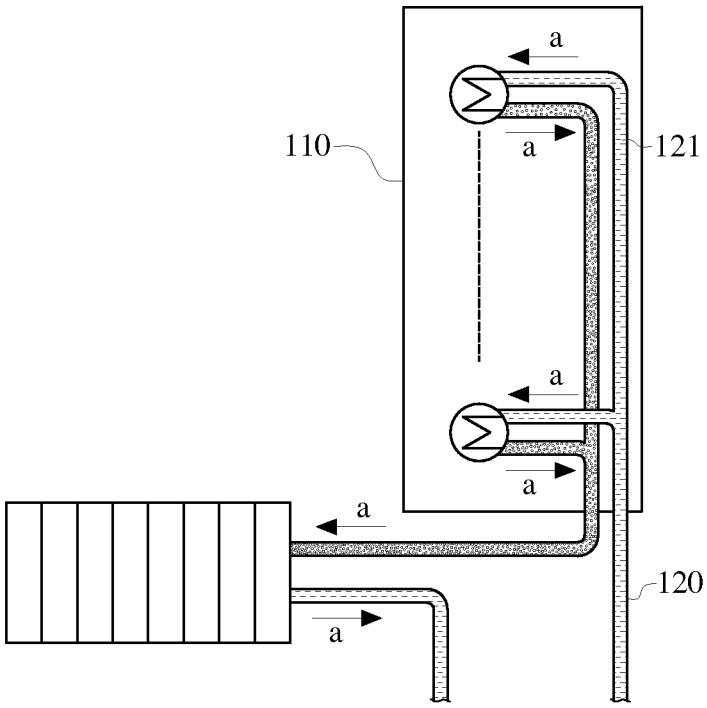
FIG. 2 is an enlarged view of a first heat exchanger and a second heat exchanger of FIG. 1.

Referring to FIGS. 1 and 2, wherein FIG. 1 is a flat illustration of a data center of a first embodiment, and FIG. 2 is an enlarged view of a first heat exchanger and a second heat exchanger of FIG. 1. A data center 10 comprises a plurality of server racks, and each of the server racks includes at least one electronic component (not illustrated). A server rack is a standardized frame or enclosure for mounting equipment modules. For example, a server rack may, in one conventional rack server embodiment, correspond to a server rack. For convenience of description, two server racks, a first server rack 12 and a second server rack 14 respectively, are depicted in the drawings, but the invention is, of course, not limited to servers with two server racks. Each of the server racks 12 and 14 has at least one rack server.

The electronic component has an operating temperature range which is between an initial operating temperature of the electronic component and a preset upper temperature limit. For example, the preset upper temperature limit can be a temperature set for protecting the electronic component from crashes or a temperature set for avoiding the electronic component from being burned out. The electronic component can be, for example, an integrated circuit chip such as a central processing unit, a display card, a south-bridge and north-bride chipset or a memory. For convenience of description, a central processing unit is used as the electronic component in this embodiment; wherein, the operating temperature range of the central processing unit is, for example, between 30° C. and 80° C.

A server rack heat dissipation system 20 of this embodiment includes a first rack heat dissipation circuit or assembly 100, a second rack heat dissipation circuit or assembly 200 and a fluid driving device 130 (such as a pump). The first heat dissipation assembly 100 includes at least one first heat exchanger 110 and a first pipeline 120. The number of first heat exchangers 110 may vary with the number of electronic components needing such cooling in the server rack. Again for the sake of easier comprehension, the drawings illustrate only one first heat exchanger 110 in each of the server racks 12 and 14. However, the number of the electronic components and the heat exchangers are not intended to be limited this way. Because the first heat dissipation assembly 100 and the second heat dissipation assembly 200 are similarly disposed in each of the server racks 12 and 14, only the first server rack 12 is described below.

The first heat exchanger 110 is disposed inside the first server rack 12 which is in high-conductivity thermal contact with an electronic component of the first server rack 12. Therefore, the heat generated by the electronic component is efficiently conducted to the first heat exchanger 110.

A first coolant 121 is inside the first pipeline 120, and the first pipeline 120 is in thermal contact with each of the first heat exchangers 110 respectively, so that the first coolant 121 exchanges heat with each of the first heat exchangers 110 in order to transfer waste heat from the electronic component to the first heat exchangers 110.

The first coolant 121 in this embodiment can be a liquid with a boiling point temperature between 50° C. and 60° C. under atmospheric pressure. In this embodiment and some embodiments, the first coolant 121 is an environmentally friendly refrigerant which is free of chlorofluorocarbon (CFC) and hydrochlorofluorocarbon (HCFC). In some embodiments, the first coolant 121 is, for example, pentafluorobutane (HFC-365mfc) or 1-methoxyheptafluoropropane (HFE-7000).

The fluid driving device 130 is connected with the first pipeline 120 to drive the first coolant 121 to cycle inside the first pipeline 120 (as indicated by directions of arrows a).

The second heat dissipation assembly 200 includes a second heat exchanger 210 which is in thermal contact with the first pipeline 120. More specifically, a portion of the first pipeline 120 for guiding the first coolant 121 to flow back from the first heat exchanger 110 to the fluid driving device 130 is in thermal contact with the second heat exchanger 210. Accordingly, when the first coolant 121 is cycled inside the first pipeline 120, the first coolant 121 exchanges heat with the first heat exchanger 110, and then it exchanges heat with the second heat exchanger 210. The second heat exchanger 210 of this embodiment is, for example, a heat dissipation assembly including heat dissipation fins and a fan. The heat dissipation fins include a plurality of parallelly arranged heat dissipation plates which are in thermal contact with the first pipeline 120. The fan blows air at the heat dissipation plates in order to remove the heat transferred from the electronic component to the heat dissipation plates.

The second heat exchanger 210 is disposed inside the first server rack 12 and is adjacent to the first heat exchanger 110. In other words, the distance between the second heat exchanger 210 and the first heat exchanger 110 is a lot shorter than that between the second heat exchanger 210 and the fluid driving device 130. Therefore, because the second heat exchanger 210 is disposed adjacent to the first heat exchanger 110, the quantity of heat generated by the electronic component can be taken away in advance in order to reduce the temperature of the first coolant 121. More specifically, if the temperature of the first coolant 121 reaches the boiling point after the heat generated by the electronic component is absorbed by the first coolant 121, at least part of the first coolant 121 will transform from liquid phase to vapor phase. Because the second heat exchanger 210 is disposed inside the first server rack 12, before the first gaseous coolant 121 leaves the first server rack 12, the first gaseous coolant 121 will transform back to liquid phase due to the heat exchange between the second heat exchanger 210 and the first gaseous coolant 121. Thereby, the second heat exchanger 210 can shorten the distance the first gaseous coolant 121 moves inside the first pipeline 120, and therefore, the flow resistance of the first coolant 121 encountered inside the first pipeline 120 can be reduced (because a flow resistance of a gas inside a pipeline is larger than that of a liquid inside a pipeline). Accordingly, the power output of the fluid driving device 130 can be reduced.

Furthermore, in this embodiment, because the first coolant 121 is in liquid phase under an environment of normal temperature and pressure, the first coolant 121 can be filled inside the first pipeline 120 directly under such environment.

Furthermore, the second heat exchanger 210 can also be a plate-type heat exchanger which includes a plurality of parallelly arranged heat conduction plates and at least a pipeline going through the heat conduction plates. The heat inside the pipeline can be conducted to air through the heat conduction plates, or can be exchanged with other pipelines.

Figure 3:
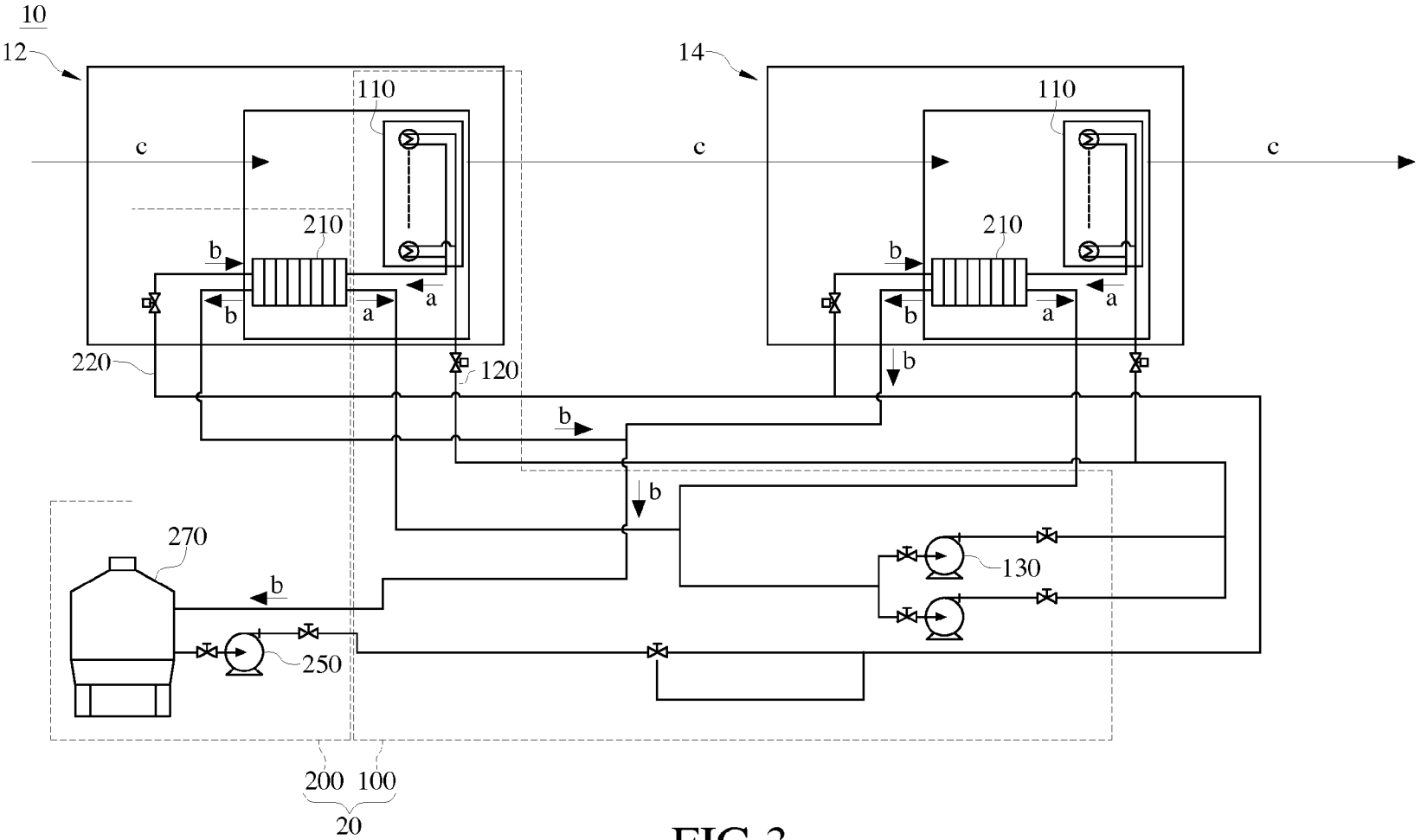
FIG. 3 is a flat illustration of a data center of a second embodiment.
Figure 4:
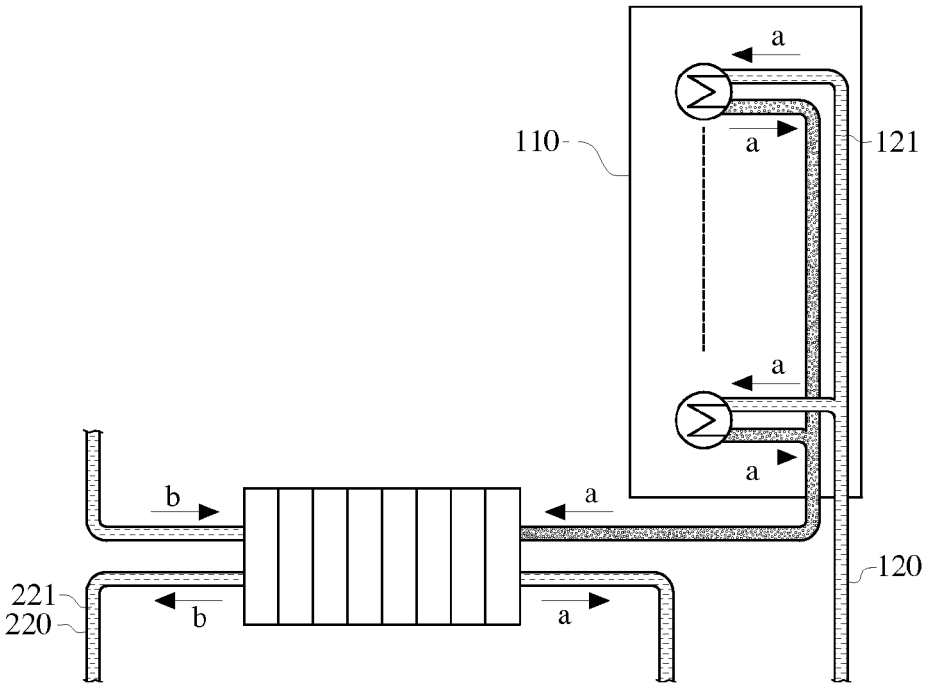
FIG. 4 is an enlarged view of a first heat exchanger and a second heat exchanger of FIG. 3.

Furthermore, referring to FIGS. 3 and 4, where FIG. 3 is a flat illustration of a data center of a second embodiment, and FIG. 4 is an enlarged view of a first heat exchanger and a second heat exchanger of FIG. 3. The differences between the second embodiment and the first embodiment lie in that, the second heat dissipation assembly 200 further comprises a second pipeline 220, a pump 250 and a water cooling tower 270. Here, a water cooling tower refers to a heat removal device used to transfer process waste heat to the atmosphere. In one embodiment, the water cooling tower 270 uses water evaporation to remove process heat and cool the working fluid to near the wet-bulb air temperature. A second coolant 221 is inside the second pipeline 220. The pump 250 is connected with the second pipeline 220 for driving the second coolant 221 to cycle inside the second pipeline 220 (as indicated by directions of arrows b). The second pipeline 220 is also in high-conductivity thermal contact with the second heat exchanger 210 so that the second coolant 221 exchanges heat with the first coolant 121 at the second heat exchanger 210. Thereby, the heat of the electronic component not only can be conducted to air through the second heat exchanger 210, but can also be transferred to the second coolant 221 through the second heat exchanger 210, so that the heat generated by the electronic component can be removed at a faster speed by the second heat exchanger 210.

Furthermore, the water cooling tower 270 in this embodiment is a closed type one, a portion of the second pipeline 220 passes inside the water cooling tower 270, and the water cooling tower 270 is able to spray water on the second pipeline 220 in order to take away the heat of the second coolant 221. The pump 250 is able to drive the cooled second coolant 221 back to the second heat exchanger 210 for heat exchange. The water cooling tower 270 is not limited to be a closed type one, it can also be an opened type water cooling tower in some embodiments, and the second pipeline 220 is connected to the water cooling tower 270 so that the second coolant 221 can be flowed inside the water cooling tower 270 directly for cooling.

The principle of the first coolant 121 cycling and operating inside the first pipeline 120 in this embodiment is described below. Firstly, a portion of the first pipeline 120 between an exit of the fluid driving device 130 and an entrance of the first heat exchanger 110 is described herein. At this point, the first coolant 121 is under normal temperature and pressure, and the first coolant 121 is in liquid phase because its temperature has not reached a boiling point temperature.

Then, the portion of the first pipeline 120 between an exit of the first heat exchanger 110 and an entrance of the second heat exchanger 210 is described herein. The temperature of the first coolant 121 increases after the first coolant absorbs the heat released by the electronic component. More specifically, inside the first heat exchanger 110, if the temperature of the electronic component is higher than the boiling point of the first coolant 121, a part of the first coolant 121 will transform from liquid phase to vapor phase, so that a large quantity of heat generated by the electronic component can be taken away by the latent heat required by the phase transition. Therefore, the first coolant 121 between the exit of the first heat exchanger 110 and the entrance of the second heat exchanger 210 is in a state of coexisting liquid and gas.

Then, the portion of the first pipeline 120 between an exit of the second heat exchanger 210 and an entrance of the fluid driving device 130 is described herein. Inside the second heat exchanger 210, because the temperature of the second coolant 221 is lower than that of the first coolant 121, and the first coolant 121 exchanges heat with the second coolant 221 flowed through the second heat exchanger 210, the temperature of the first coolant 121 is reduced by releasing its heat, and the temperature of the second coolant 221 is increased by absorbing the heat released by the first coolant 121. Accordingly, all or most of the first gaseous coolant 121 can transform back to liquid phase inside the second heat exchanger 210. Therefore, even though the first coolant 121 between the exit of the second heat exchanger 210 and the entrance of the fluid driving device 130 may still be in a state of coexisting liquid and gas, comparing with the portion of the first pipeline 120 between the exit of the first heat exchanger 110 and the entrance of the second heat exchanger 210, almost all of the first coolant 121 in this portion is in liquid phase.

Figure 5:
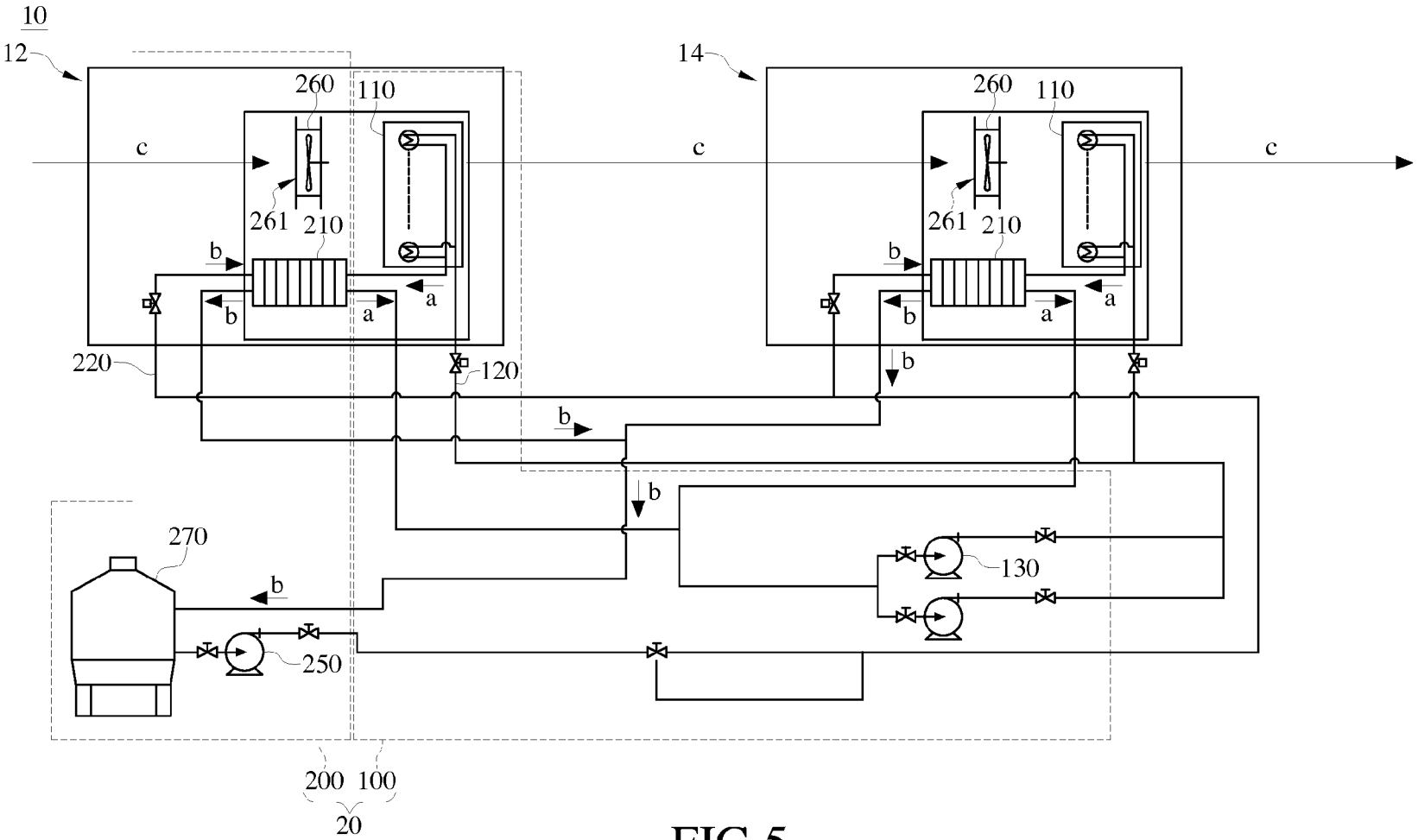
FIG. 5 is a flat illustration of a data center of a third embodiment.

FIG. 5 is a flat illustration of a data center of a third embodiment. In order to make the first server rack 12 dissipate heat more effectively, the second heat dissipation assembly 200 further comprises an air circulating apparatus 260. The air circulating apparatus 260 is, for example, a fan. The air circulating apparatus 260 is disposed inside the first server rack 12 driving a flow of air from outside the first server rack 12 into and through the first server rack 12 (as indicated by a direction of an arrow c) so as to reduce the temperature inside the first server rack 12.

Figure 6:
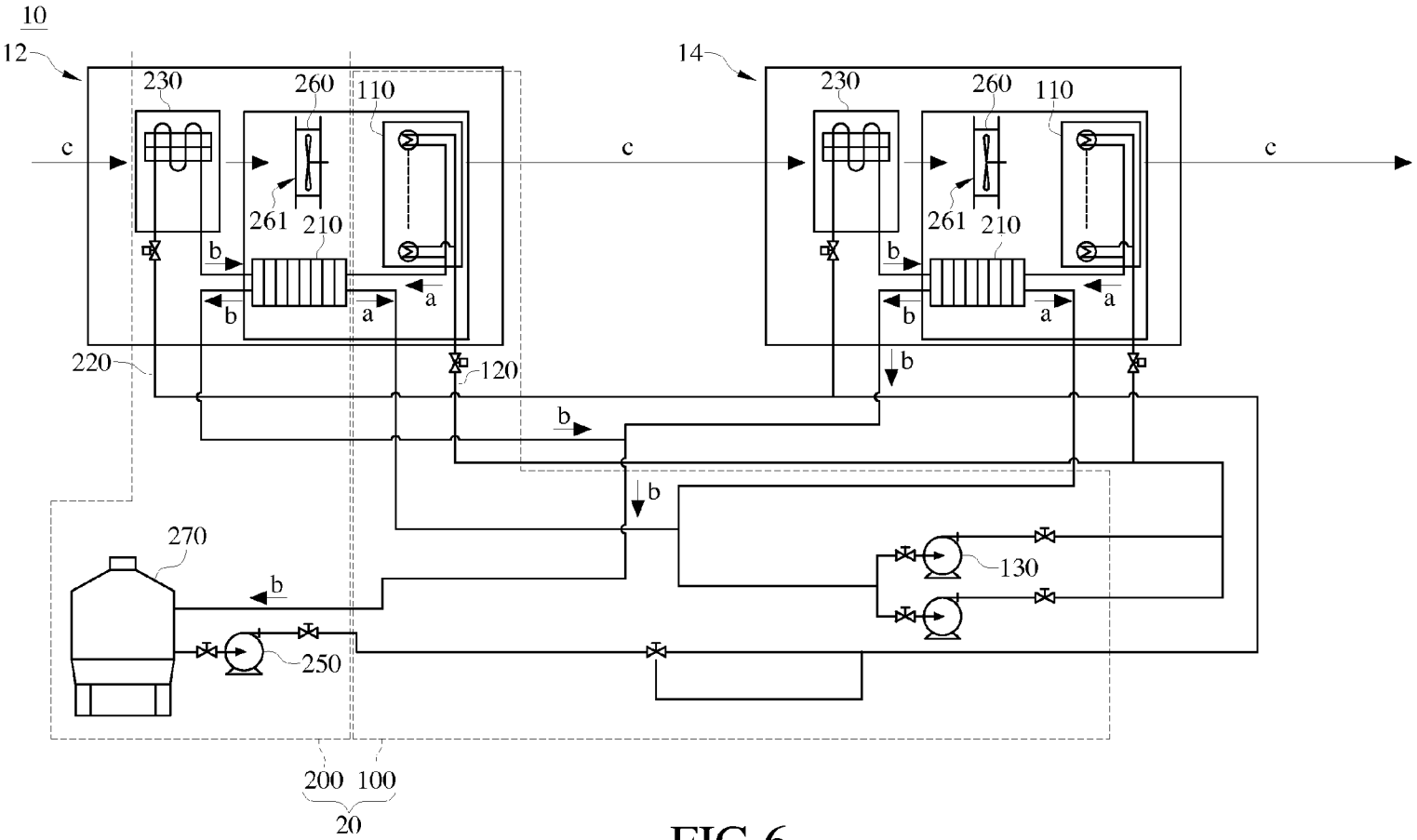
FIG. 6 is a flat illustration of a data center of a fourth embodiment.

Referring to FIG. 6 is a flat illustration of a data center of a fourth embodiment. In order to have a better temperature reduction effect inside the first server rack 12, the second heat dissipation assembly 200 further comprises a third heat exchanger 230 disposed at an air inlet end 261 of the air circulating apparatus 260. In this embodiment, the third heat exchanger 230 is disposed inside the first server rack 12. Furthermore, the third heat exchanger 230 is in thermal contact with the second pipeline 220, and is disposed between the pump 250 and the second heat exchanger 210. The disposing position of the third heat exchanger 230 can allow the second coolant 221 inside the second pipeline 220 to exchange heat with the third heat exchanger 230 first. Then the second coolant 221 flowed from the third heat exchanger 230 exchanges heat with the second heat exchanger 210.

Based on the way the third heat exchanger 230 is disposed, the air extracted from outside the first server rack 12 into the first server rack 12 by the air circulating apparatus 260 will flow through the third heat exchanger 230 and exchange heat with the third heat exchanger 230, and therefore the temperature of the air flowed into the first server rack 12 can be reduced by the third heat exchanger 230.

Figure 7:
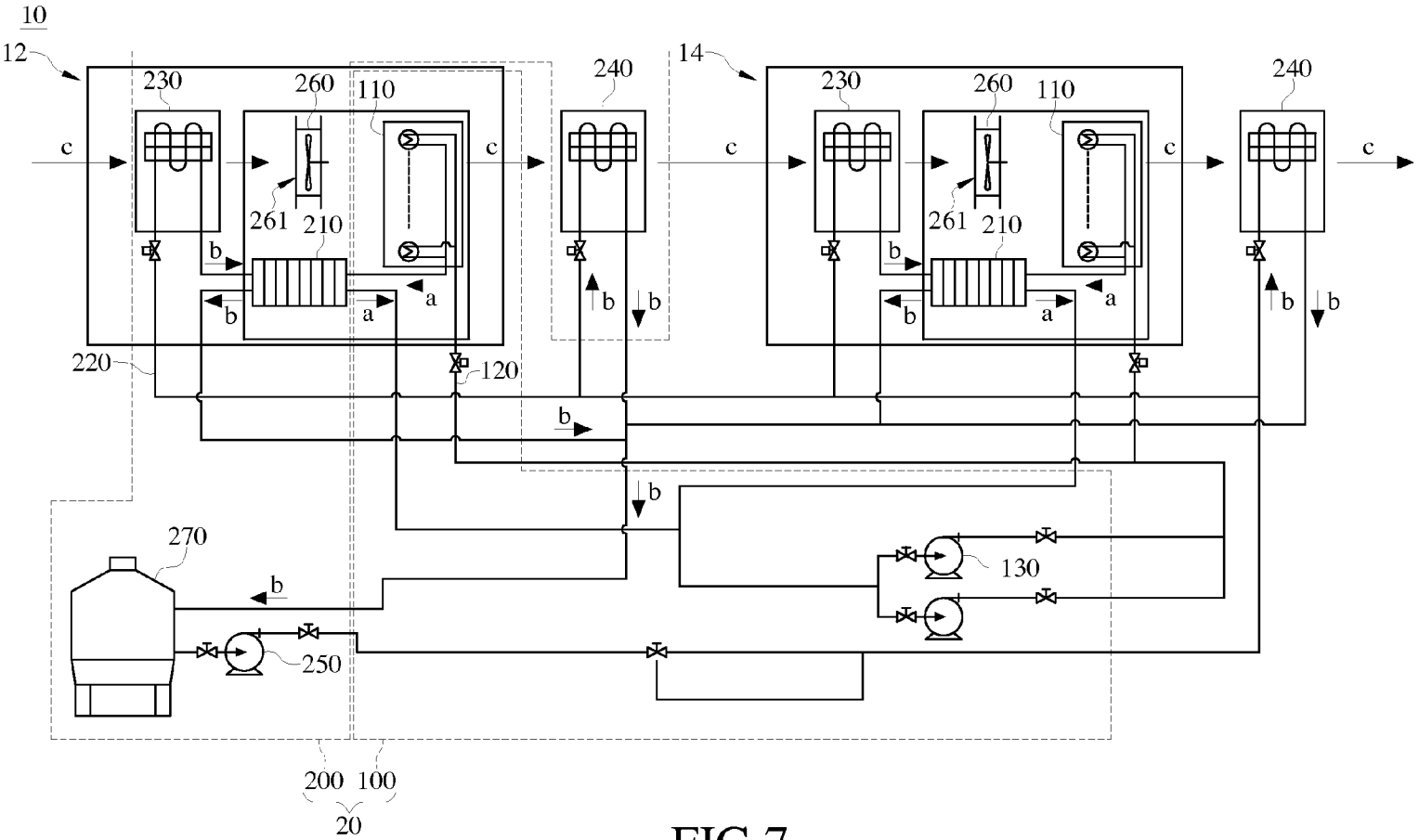
FIG. 7 is a flat illustration of a data center of a fifth embodiment.

FIG. 7 is a flat illustration of a data center of a fifth embodiment. In this embodiment and some embodiments, the second heat dissipation assembly 200 further comprises a fourth heat exchanger 240 disposed between the first server rack 12 and the second server rack 14. The second coolant 221 inside the second pipeline 220 is flowed from the water cooling tower 270 to the fourth heat exchanger 240 to exchange heat, and then it is flowed back to the water cooling tower 270. Afterwards, the water cooling tower 270 removes the heat of the second coolant 221 absorbed at an air outlet of the first server rack 12, so that the second coolant 221 can start a cooling cycle again.

The fourth heat exchanger 240 exchanges heat with the hot air flowed out from the first server rack 12 first, and the temperature of the hot air is reduced before flowing into the second server rack 14, so as to enhance a heat dissipation effect of air flow inside the second server rack 14, and to prevent a waste heat output by the first server rack 12 from accumulating inside the second server rack 14.

Figure 8:
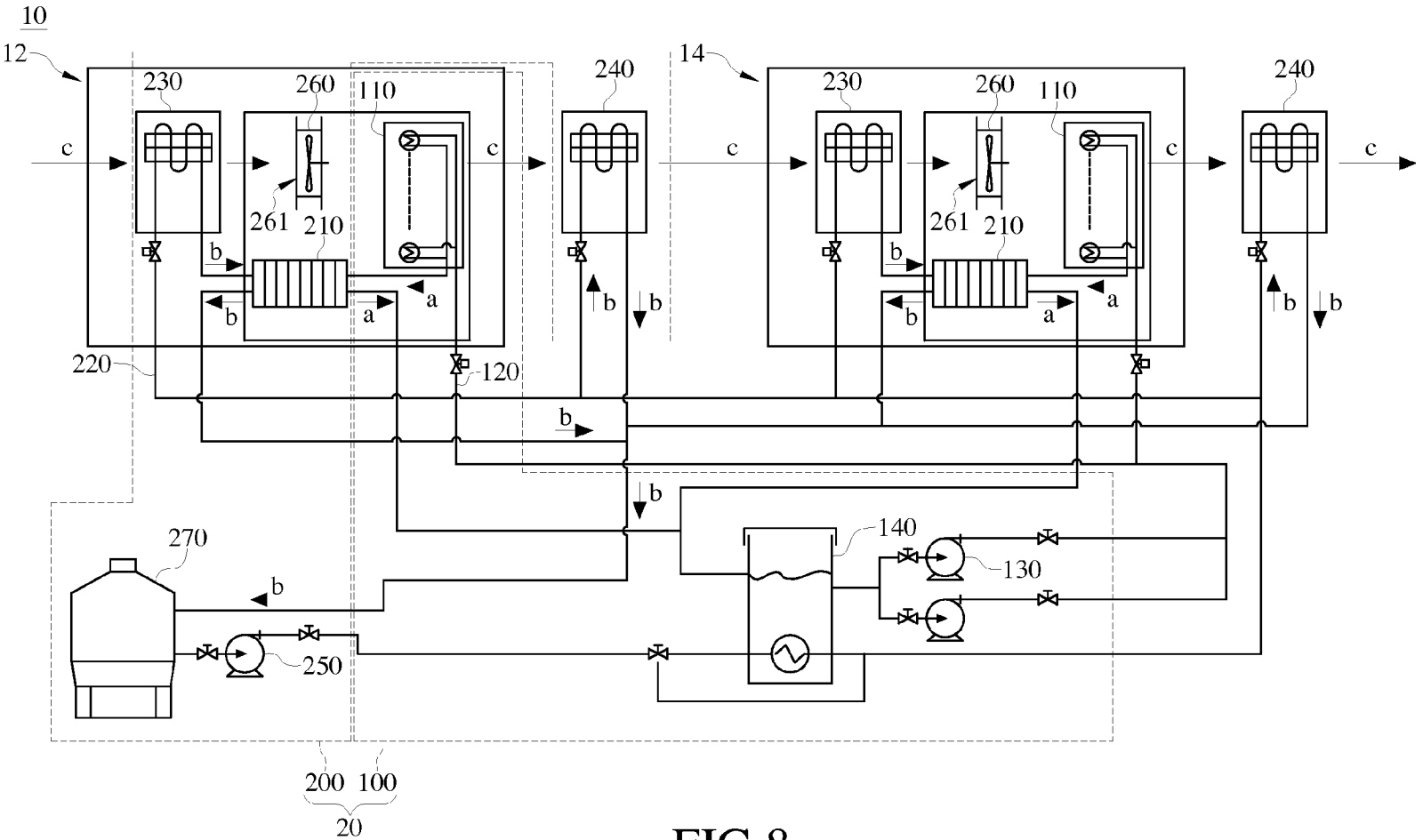
FIG. 8 is a flat illustration of a data center of a sixth embodiment.

FIG. 8 is a flat illustration of a data center of a sixth embodiment. In this embodiment and some embodiments, where there might otherwise be insufficient time for the second heat exchanger 210 to condense most of the first coolant 121 into liquid phase, a regulating valve (not illustrated) is disposed at the second pipeline 220 for regulating the flow rate of the second coolant 221. Furthermore, in order to ensure that the pressure inside the first pipeline 120 is not overloaded, the first heat dissipation assembly 100 can further include a liquid storage tank 140. The liquid storage tank 140 is connected with the first pipeline 120 and the fluid driving device 130 respectively, and is disposed at the entrance of the fluid driving device 130. Therefore, if the first coolant 121 in coexisting states of liquid and gas is stored in the liquid storage tank 140, the first liquid and gaseous coolant 121 will be separated. Accordingly, the first gaseous coolant 121 will not flow into the fluid driving device 130, and therefore, the damage of the fluid driving device 130 is prevented. Furthermore, as the first coolant 121 sits inside the liquid storage tank 140, the first coolant 121 can be cooled down naturally.

According to the heat dissipation system disclosed in the abovementioned embodiments, the second heat exchanger is in thermal contact with the first pipeline in order to exchange heat, and each of the second heat exchangers is disposed inside each of the server racks respectively. Thereby, before the first gaseous coolant flowed from the first heat exchanger leaves the server rack, the second heat exchanger can exchange heat with the first coolant in advance, so as to shorten a time the first coolant maintained in vapor phase. Therefore, a distance the first gaseous coolant moves inside the first pipeline can be shortened substantially; by such a disposition of the second heat exchanger, a flow resistance the first coolant encountered can be reduced when it is flowing inside the first pipeline. Thereby, in comparing with conventional techniques, less power is required by the fluid driving device in the abovementioned embodiment, and it is already adequate to drive the first coolant to cycle inside the first pipeline.

Furthermore, when each of the server racks has one of the second heat exchangers disposed inside, and if one of the second heat exchangers is damaged, the second heat exchangers inside the other server racks can still operate in order to reduce the temperatures inside the server racks continuously, so that the electronic components will not get damaged because of the exceeding temperatures inside the server racks.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. A server rack heat dissipation system for a server rack including an electronic component, the server rack heat dissipation system comprising:

a first heat dissipation assembly, comprising:

a first heat exchanger disposed inside the server rack and being in thermal contact with the electronic component;

a first pipeline being in thermal contact with the first heat exchanger and having a first coolant; and a second heat dissipation assembly including a second heat exchanger, a water cooling tower, a second pipeline and a pump, the second heat exchanger being disposed inside the server rack and being in thermal contact with the first pipeline, a portion of the second pipeline being in thermal contact with the second heat exchanger, and another portion of the second pipeline being disposed inside the water cooling tower, a second coolant being inside the second pipeline, and the pump being connected with the second pipeline for driving the second coolant to cycle inside the second pipeline;

wherein when the heat dissipation system is in operation, the first coolant inside the first pipeline exchanges heat with the first heat exchanger, and then the first coolant inside the first pipeline exchanges heat with the second heat exchanger; and wherein when the heat dissipation system is in operation, the second coolant inside the second pipeline exchanges heat with the second heat exchanger, then the second coolant inside the second pipeline exchanges heat with the water cooling tower.

2. The heat dissipation system as claimed in claim 1, wherein the second heat exchanger is a plate-type heat exchanger.

3. The heat dissipation system as claimed in claim 1, wherein the second heat dissipation assembly further comprises a third heat exchanger, the third heat exchanger is in thermal contact with the second pipeline, the third heat exchanger is disposed inside the server rack and is disposed between the pump and the second heat exchanger; and when the heat dissipation system is in operation, the second coolant inside the second pipeline exchanges heat with both the second and third heat exchangers.

4. The heat dissipation system as claimed in claim 3, wherein the second heat dissipation assembly further includes an air circulating apparatus, the air circulating apparatus is disposed inside the server rack and is between the electronic component and the third heat exchanger, and the air circulating apparatus is configured to generate an air current flowing from the third heat exchanger towards the first heat exchanger.

5. The heat dissipation system as claimed in claim 1, wherein the first heat dissipation assembly further includes a liquid storage tank, and the liquid storage tank being connected between the first pipeline and an entrance end of a fluid driving device.

6. The heat dissipation system as claimed in claim 1, wherein the electronic component has an operating temperature range, and a boiling point of the first coolant is within the operating temperature range of the electronic component.

7. A data center heat dissipation system comprising:

a first rack heat dissipation circuit, comprising:

a first pipeline carrying a first coolant;

a first heat exchanger, in thermal contact with an electronic component disposed inside a server rack and the first pipeline, for transferring heat from the electronic component to the first pipeline; and a second heat exchanger inside the server rack, relatively proximate to the first heat exchanger and in thermal contact with the first pipeline, the second heat exchanger being adapted to remove heat from the first pipeline;

a first fluid driving device, relatively distal to the first and second heat exchangers, being adapted to circulate the first coolant through the first pipelines; and a second rack heat dissipation circuit, comprising:

a second pipeline carrying a second coolant isolated from the first coolant, wherein the first and second coolants do not mix;

the second pipeline also being in thermal contact with the second heat exchanger for removing heat from the second heat exchanger;

a third heat exchanger in thermal contact with the second pipeline; and a second fluid driving device relatively distal to the first and second heat exchangers circulating the first coolant through the first pipeline;

wherein when the heat dissipation system is in operation, the first coolant circulates through the first pipeline to remove heat from the electronic component and transfer it to the second heat exchanger, and the second coolant circulates through the second circuit to remove heat from the second heat exchanger and transfer it to the third heat exchanger.

8. The server heat dissipation system of claim 7, wherein the third heat exchanger is a water cooling tower.

9. The server heat dissipation system of claim 7, further comprising a fan for forcing a flow of cool air through the third heat exchanger.

10. The server heat dissipation system of claim 7, wherein the first rack heat dissipation circuit comprises a plurality of first heat exchangers in thermal contact with a plurality of first pipelines and a plurality of electronic components, wherein the first pipelines are fluidly linked together, and the first fluid driving device circulates coolant through all of the first pipelines.

11. The server heat dissipation system of claim 10, wherein the second rack heat dissipation circuit comprises a plurality of third heat exchangers, each cooled by a flow of forced air, in thermal contact with a plurality of second pipelines, wherein the second pipelines are fluidly linked together, and the second fluid driving device circulates coolant through all of the second pipelines.

12. The server heat dissipation system of claim 11, wherein:

the system is installed in a data center comprising a plurality of server racks, each of the server racks having a plurality of rack servers;

a cooling air flow is provided through the server racks;

one of the plurality of third heat exchangers is positioned at an entrance to the air flow;

another of the plurality of third heat exchangers is positioned at exit to the air flow; and each of one or more remaining third heat exchangers is positioned between adjacent ones of the plurality of server racks;

wherein the one or more remaining third heat exchangers remove heat from the flowing air as it flows to subsequent server racks.

13. The server heat dissipation system of claim 12, the first rack heat dissipation circuit further comprising a liquid storage tank, for separating liquid and gaseous coolant, located upstream of the first fluid driving device, wherein the liquid storage tank is fluidly coupled to the first fluid driving device through an outlet located near a bottom of the liquid storage tank.

14. A method of removing waste heat from electronic components in a server, the method comprising:

circulating a first cooling fluid through a first heat dissipation pipeline circuit that is in thermal contact with a pair of relatively proximately located first and second heat exchangers, the first heat exchanger being in thermal contact with an electronic component, the first rack heat dissipation circuit including a first fluid driving device located relatively distal of the pair of first and second heat exchangers;

circulating a second cooling fluid through a second heat dissipation pipeline circuit that is in thermal contact with the second heat exchanger, the second cooling fluid removing heat from the second heat exchanger, wherein the second heat dissipation pipeline circuit is in thermal contact with a third heat exchanger;

circulating the second cooling fluid through the third heat exchanger; and forcing a flow of air over the third heat exchanger to remove heat from the third heat exchanger.

15. The method of claim 14, wherein the first heat dissipation pipeline circuit is in thermal contact with a plurality of pairs of relatively proximately located first and second heat exchangers, the first fluid driving device circulating the first cooling fluid through all of the pairs of first and second heat exchangers.

16. The method of claim 15, wherein the second heat dissipation pipeline circuit is in thermal contact with each of the second heat exchangers, the second heat dissipation pipeline circuit having a second fluid driving device, the second fluid driving device circulating the second cooling fluid through all of the second heat exchangers.

17. The method of claim 16, wherein the second heat dissipation pipeline circuit is in thermal contact with a plurality of third serially arranged heat exchangers, the method further comprising forcing a flow of air over the serially arranged third heat exchangers to transfer and dissipate heat from the second cooling fluid.

18. The method of claim 14, further comprising:

selecting a first cooling fluid having a boiling point that is within an operating temperature range of the electronic component;

transferring heat away from the electronic component primarily through a transition from a liquid phase to a gas phase; and transferring a sufficient amount of heat from the first cooling fluid to the second heat exchanger to re-transition most of any gaseous phase of the first cooling fluid back into a liquid phase.

* * * * *